US011022129B2

(12) United States Patent
Yao

(10) Patent No.: US 11,022,129 B2
(45) Date of Patent: Jun. 1, 2021

(54) PRESSURIZED COOLING FAN AND INSTRUCTIONS FOR USE

(71) Applicant: NINGBO SHENGJIU THERMAL TECH CO.,LTD, Yuyao (CN)

(72) Inventor: Chunliang Yao, Yuyao (CN)

(73) Assignee: NINGBO SHENGJIU THERMAL TECH CO., LTD, Yuyao (CN)

( * ) Notice: Subject to any disclaimer, the term of this patent is extended or adjusted under 35 U.S.C. 154(b) by 0 days.

(21) Appl. No.: 16/410,225

(22) Filed: May 13, 2019

(65) Prior Publication Data

US 2019/0345947 A1 Nov. 14, 2019

(30) Foreign Application Priority Data

May 11, 2018 (CN) ..... 201810447607.2

(51) Int. Cl.
*F04D 19/00* (2006.01)
*F04D 25/08* (2006.01)
*F04D 29/38* (2006.01)

(52) U.S. Cl.
CPC ..... *F04D 19/007* (2013.01); *F04D 25/08* (2013.01); *F04D 29/384* (2013.01)

(58) Field of Classification Search
CPC ..... F04D 19/007; F04D 25/08; F04D 19/002; F04D 19/024; F04D 29/384
USPC ..... 415/68
See application file for complete search history.

(56) References Cited

U.S. PATENT DOCUMENTS 2,056,547 A * 10/1936 Weber ..... F04D 29/34 416/188
7,946,805 B2 * 5/2011 Yoshida ..... F04D 19/007 415/219.1
2018/0135650 A1 * 5/2018 Chang ..... F04D 27/009

FOREIGN PATENT DOCUMENTS

CN 207033785 U 2/2018

* cited by examiner

*Primary Examiner* — Eldon T Brockman
*Assistant Examiner* — Michael L Sehn
(74) *Attorney, Agent, or Firm* — Oliff PLC

(57) ABSTRACT

A pressurized cooling fan and instructions for use, which is designed specifically to solve poor cooling effect due to poor effect of pressurizing of existing similar products and the technical issues of inconvenience of production, and high production cost. The fan frame of this cooling fan is provided with inner blades, a motor assembly is provided in the guard of inner blades. Airflow enters into the fan frame through the gap between outer blades and inner blades, and is guided out through the hollow hole in the rear of the fan frame, the top plane of inner blades is lower than the frame plane of the fan frame; outer blades and inner blades are integrally connected and relatively rotate when the motor assembly rotates, the air passes through the rear part of the fan frame that is guided by the gap between the fan frame, outer blades and inner blades.

7 Claims, 2 Drawing Sheets

PRESSURIZED COOLING FAN AND INSTRUCTIONS FOR USE

FIELD OF TECHNOLOGY

The present invention relates to a cooling fan or precisely, a pressurized cooling fan and instructions for use.

BACKGROUND OF THE INVENTION

The cooling fan generally refers to a fan used for heat dissipation of motherboards such as CPU and graphics card, some cooling fans are also provided with cooling fins with a view to conducting heat and blowing it to the air nearby for cooling purpose. Such cooling fans have been extensively used in metal cabinet doors such as cabinets and electric control cabinets, and generally no cooling fin structure is required. For the single-rotor cooling fans in use, its effective air intake area is narrower, when the static pressure it provides is inadequate, a conventional method is to add double-rotor cooling fan, that is, to add a reverse cooling fan at the outlet side, in order to increase greater static pressure. However, it has very obvious disadvantages, the power consumption of the cooling fan is doubled, so is the cost. For example, the application reference: 201720968083. 2, publication date: 23 Feb. 2018, description of the invention: "Double-motor Double-fan Pressurized Fan" disclosed in Chinese patent document; the fan comprises a fan frame; a rotating mechanism mounted at the center of the fan frame; a power cord with USB interface that is electrically connected to the rotating mechanism; wherein the rotating mechanism comprises a motor bracket, the first motor and the second motor provided at both ends of the motor bracket respectively; a shifting fork that is mounted on the motor bracket; the first fan blade vane that is mounted on the output shaft of the first motor; the second fan blade vane that is mounted on the output shaft of the second motor; the first fan blade comprises the first axis and the second blade that is uniformly dispersed around the outer periphery of the second axis. However, this structure is double-blade and double-motor, which doesn't bring about a more effective effect of pressurizing, is difficult to be used for heat dissipation inside the metal cabinet door, and its production process is more complex at a higher cost.

BRIEF SUMMARY AND OBJECTS OF THE INVENTION

To overcome the above deficiencies, the object of the present invention is to provide a pressurized cooling fan that is used for a metal cabinet door and instructions for use, in order to solve the poor cooling effect due to poor effect of pressurizing of existing similar products, and the technical issues of inconvenience of production and higher production cost. This object is achieved by the following technical solutions.

A pressurized cooling fan, wherein the fan frame of this cooling fan is provided with inner blades, the inner blades guard is provided with a motor assembly; wherein the design points of this structure is that the outer diameter of the guard of the inner blades is provided with outer blades smaller than the diameter of inner blades, the airflow enters into the fan frame through the gap between outer blades and inner blades, and is guided out through the hollow hole in the rear of the fan frame, the top plane of inner blades is lower than the frame plane of the fan frame; outer blades and inner blades are integrally connected and relatively rotate when the motor assembly rotates. In this way, the effective intake area of the cooling fan substantially increases, the air volume and static pressure will significantly rise; the outer blades and inner blades are integrated to increase higher air volume and static pressure, that is, to reduce to less power consumption for higher air volume and static pressure, and the original inner blades are shared to reduce the cost by ¼.

The bottom of the outer blades guard is relatively engaged with the top of the inner blades guard through the ring. As a result, when the motor assembly drives inner blades to rotate, there is relative rotation between outer blades and inner blades, and there is airflow gap between blades.

The outer blades are coaxially connected with inner blades through the motor assembly. The relative engagement or coaxial connection is enough as long as there is airflow gap between blades when the motor assembly is operating.

The inner blades are single-rotor blades, outer blades are pressurized blades, the area of outer blades is smaller than that of inner blades. The combination of two different blades and the control over area further increases the effective intake area. The inner blades are 5-blade vanes, and the outer blades are 7-blade vanes. The combination of the two numbers of blades is the best embodiment.

The top of the inner blades guard has a flat surface, the outer blade guard is provided at the center of the outer blades and is a conical convex blade guard, and blades are provided on the outer diameter bevel of the outer blades guard. The structure further enhances the air intake effect of the effective intake zone through the outer blades structure, that is, to produce a conical spiral intake passage.

The diameter of the top of the inner blades guard is smaller than that of the rear part of the inner blades guard, namely the guard of inner blades is a bevel. The structure further enhances the air intake effect of the effective intake zone through the inner blades structure.

The hollow hole of the fan frame is located in the outer side of the rear guard corresponding to the central axis of the guard. The structure is a specific embodiment structure of the fan frame.

According to the above structure features, the instructions for use is: the motor assembly drives inner blades to rotate, while outer blades and inner blades relatively rotate, the air passes through the rear part of the fan frame that is guided by the gap between the fan frame, outer blades and inner blades, so that the air is driven from the fan frame in the outer side of outer blades to one side of inner blades in the fan frame.

The present invention has reasonable structural design, convenience of production and processing, lower production cost, higher air volume, and better static pressure; it can be suitably used for the metal cabinet door as pressurized cooling fan and for the further improvement of similar products.

DESCRIPTION OF THE EMBODIMENT

Figure 1:
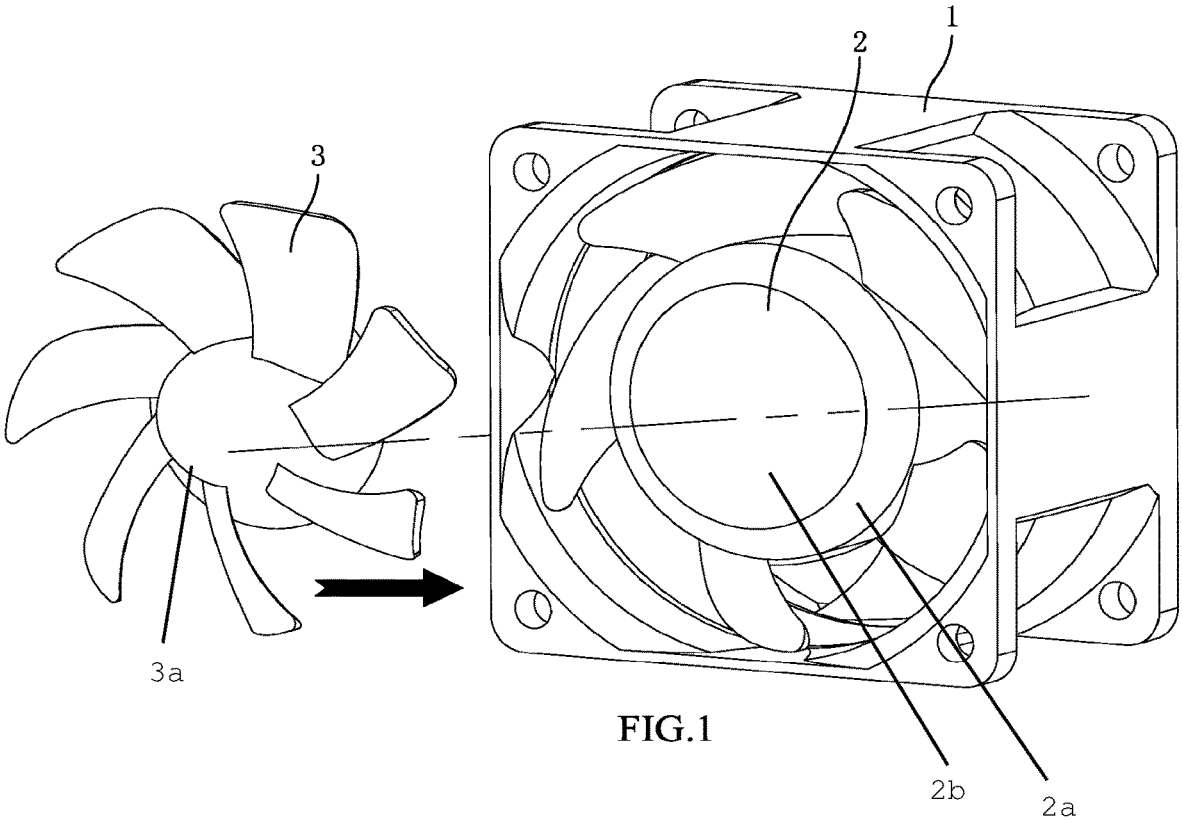
FIG. 1 is a schematic view showing the mounting structure of the present invention, in which the arrow indicates the mounting direction.
Figure 2:
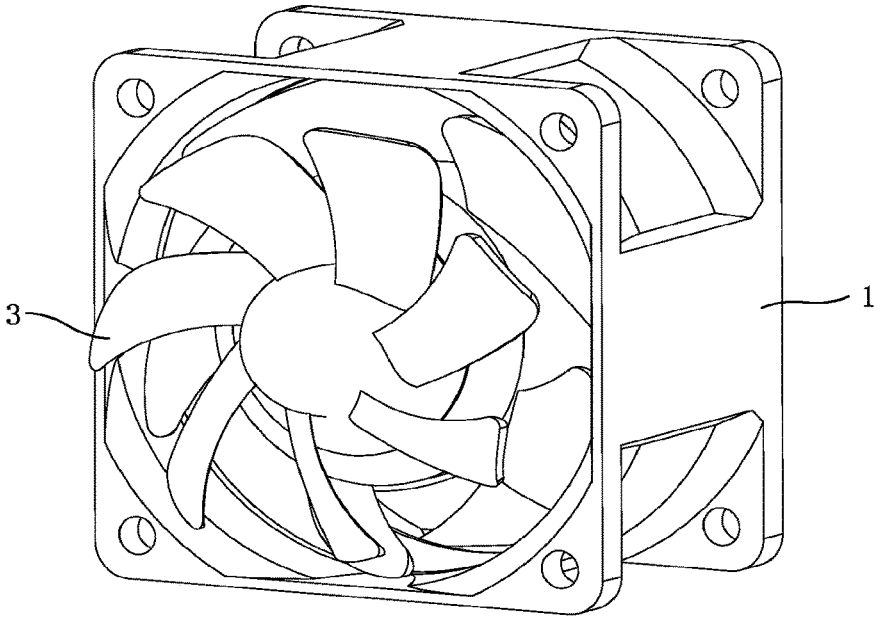
FIG. 2 is a schematic perspective view of the present invention.
Figure 3:
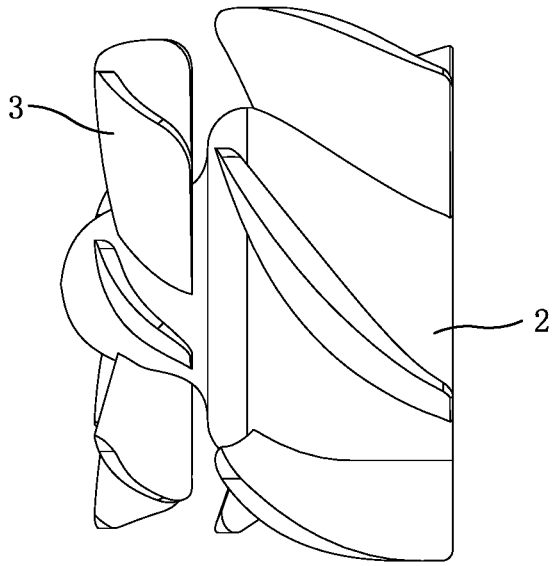
FIG. 3 is a schematic view of inner fans structure of the present invention.
Figure 4:
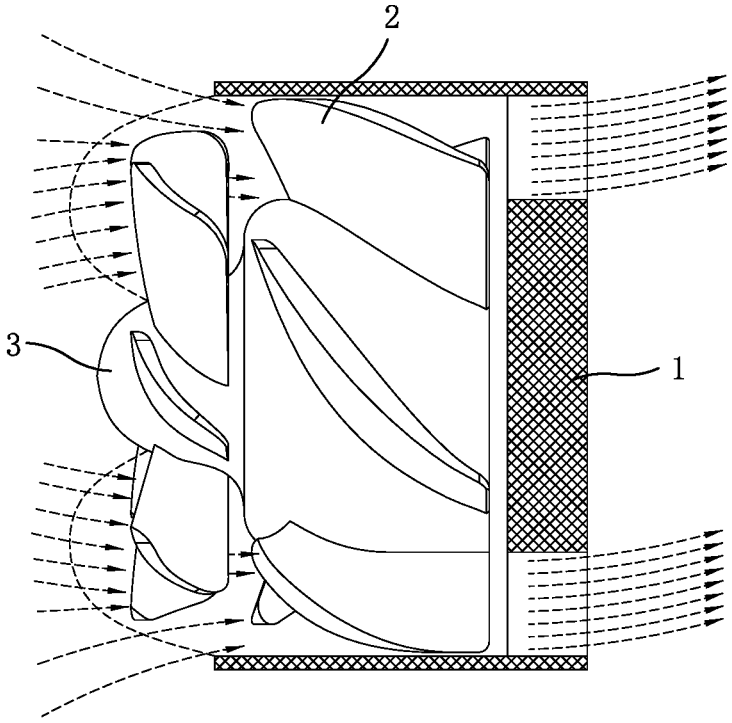
FIG. 4 is a partial cross-sectional structural view of the working principle of the present invention and the arrow indicates the airflow direction.

The structure and use of the present invention is now further described with reference to the attached drawings. As shown in FIG. 1-4, the fan frame 1 of this cooling fan is provided with inner blades 2, a motor assembly is provided in the inner blades guard 2*a*; in addition, the outer diameter of the top of the inner blades guard 2*a* is provided with outer blades 3 smaller than the diameter of inner blades 2, inner blades 2 are 5-blade single-rotor vanes, outer blades 3 are 7-blade pressurizing vanes, the area of outer blades 3 is smaller than that of inner blades 2, the top plane of inner blades 2 is lower than the frame plane of the fan frame 1, the top plane of inner blades 2 is lower than that of the frame opening of the fan frame 1. The top of the inner blades guard has a flat surface, the center of outer blades is provided with a outer blades guard 3*a* that is conical and convex, and the outer blades 3 are provided on the outer diameter bevel of the outer blades guard 3*a*; the diameter of the top of the inner blades guard 2*a* is smaller than the diameter of the rear part of the inner blades guard 2*a*, namely the inner blades guard 2*a* is bevel; the hollow hole of the fan frame is located in the outer side of the rear guard corresponding to the central axis of the guard.

In the structure, outer blades 3 are integrally connected with inner blades 2 and relatively rotate when the motor assembly rotates, the connection between outer blades 3 and inner blades 2 is achieved by two methods: Scheme 1, the bottom part of the guard of outer blades 3 is relatively engaged with the top plane of the inner blades guard 2*a* through the ring 2*b*, when the motor assembly drives inner blades 2 to rotate, outer blades 3 rotate on inner blades 2 and keep integrally engaged; Scheme 2, outer blades 3 are coaxially connected with inner blades 2 through the motor assembly, the motor assembly drives inner and outer blades 2, 3 to rotate simultaneously, outer and inner blades 2, 3 relatively rotate through the motor assembly. In addition, the bottom part of the outer blades guard is engaged with the top plane of the inner blades guard, because the friction arising from the engagement between outer blades 3 and inner blades 2 is greater or smaller than the rotation of the motor assembly, outer and inner blades 3, 2 will also relatively rotate through the motor assembly.

Its working principles are described below: the airflow enters into the fan frame through the gap between outer blades 3 and inner blades 2, and is guided out through the hollow hole in the rear of the fan frame 1. The motor assembly drives inner blades 2 to rotate, while outer blades 3 and inner blades 2 relatively rotate, the air passes through the rear part of the fan frame 1 that is guided by the gap between the fan frame, outer blades 3 and inner blades 2, so that the air is driven from the fan frame 1 in the outer side of outer blades 3 to one side of inner blades 2 in the fan frame 1.

The invention claimed is:

1. A pressurized cooling fan, comprising:

a fan frame;

a plurality of inner blades; and a plurality of outer blades, wherein the plurality of inner blades are disposed on an inner blades guard and together form an inner blades structure, and the inner blades guard is provided with a motor assembly, wherein the plurality of outer blades are disposed on an outer blades guard and together form an outer blades structure, wherein a diameter of the inner blades structure is larger than a diameter of the outer blades structure, wherein airflow is configured to enter into the fan frame through a gap between the outer blades and the inner blades, and is configured to be guided out through a hollow hole in a rear of the fan frame, wherein a top portion of the inner blades structure is disposed to be lower than a top portion of the fan frame, wherein the outer blades and the inner blades are integrally connected and relatively rotate when the motor assembly rotates, wherein the outer blades guard projects outside of an outermost surface of the fan frame, and the outer blades are provided outside of the outermost surface of the fan frame, wherein the outer blades guard is disposed within a ring of the inner blades guard, and the outer blades structure and the inner blades structure are connected to each other.

2. The pressurized cooling fan according to claim 1, wherein the outer blades are coaxially connected with the inner blades through the motor assembly.

3. The pressurized cooling fan according to claim 1, wherein the inner blades are single-rotor blades, the outer blades are pressurized blades, and an area of the outer blades is less than an area of the inner blades.

4. The pressurized cooling fan according to claim 3, wherein the inner blades are 5-blade vanes, and the outer blades are 7-blade vanes.

5. The pressurized cooling fan according to claim 1, wherein the inner blades guard includes a flat surface, the outer blades guard is provided at a center of the outer blades and is conical and convex, and the blades are provided on an outer diameter bevel of the outer blades guard.

6. The pressurized cooling fan according to claim 5, wherein the inner blades guard is a bevel.

7. A method of cooling with the pressurized cooling fan according to claim 1, the method comprising:

driving, using the motor assembly, the inner blades, to cause the inner blades to rotate while the outer blades and inner blades relatively rotate, wherein the airflow passes through a rear part of the fan frame that is guided by the gap between the outer blades and the inner blades, so that the airflow is driven from the fan frame in an outer side of outer blades to one side of the inner blades in the fan frame.

* * * * *